US006589340B1

(12) United States Patent
Bernert et al.

(10) Patent No.: US 6,589,340 B1
(45) Date of Patent: Jul. 8, 2003

(54) MACHINE FOR DIRECT OR INDIRECT APPLICATION OF A LIQUID OR VISCOUS COATING MEDIUM ONTO A MOVING SURFACE

(75) Inventors: Richard Bernert, Giengen (DE); Benjamin Méndez-Gallon, Königsbronn (DE)

(73) Assignee: Voith Sulzer Papiertechnik Patent GmbH, Heidenheim (DE)

( * ) Notice: Subject to any disclaimer, the term of this patent is extended or adjusted under 35 U.S.C. 154(b) by 0 days.

(21) Appl. No.: 09/448,689

(22) Filed: Nov. 24, 1999

(30) Foreign Application Priority Data

Nov. 25, 1998 (DE) ..... 198 54 448

(51) Int. Cl.[7] ..... B05C 1/08
(52) U.S. Cl. ..... 118/262; 118/414
(58) Field of Search ..... 118/117, 118, 118/414, 413, 419, 262; 427/359, 361, 365

(56) References Cited

U.S. PATENT DOCUMENTS

| | | | | |
|---|---|---|---|---|
| 3,817,208 A | | 6/1974 | Barnscheidt et al. | 118/119 |
| 4,245,582 A | * | 1/1981 | Alheid et al. | |
| 4,834,018 A | | 5/1989 | Sollinger et al. | 118/410 |
| 5,624,495 A | | 4/1997 | Trefz et al. | 118/122 |
| 5,665,163 A | * | 9/1997 | Li et al. | 118/413 |
| 5,968,269 A | * | 10/1999 | Richter | 118/413 |
| 6,203,615 B1 | | 3/2001 | Münch | 118/119 |

FOREIGN PATENT DOCUMENTS

| | | | | |
|---|---|---|---|---|
| DE | G 91 03 571.6 | | 9/1992 | B05C/11/04 |
| DE | 43 41 341 C1 | | 3/1995 | B05C/11/02 |
| DE | 197 23 458 A1 | | 12/1998 | B05C/5/02 |
| GB | 2 040 738 A | | 9/1980 | B05C/11/02 |
| GB | 2 163 069 A | | 6/1985 | B05C/11/02 |
| WO | 93/05887 | * | 4/1993 | |

* cited by examiner

*Primary Examiner*—Brenda A. Lamb
(74) *Attorney, Agent, or Firm*—Taylor & Aust, P.C.

(57) ABSTRACT

A coating machine serves to directly or indirectly apply a liquid or viscous coating medium onto a moving surface. A coater imbedded in a coater bed, defines in part the metering slot. A limiting surface at the moving surface inlet of the coater bed forms, together with the moving surface, an accumulator chamber, with the opening facing in the opposite direction with respect to the feed direction. The accumulator chamber gradually reduces its volume, and the coating medium, delivered to the accumulator chamber by the moving surface, accumulates in the area ahead of the metering slot. It further includes pneumatic pressure device to alter the relative position of the limiting surface with respect to the moving surface and thus alter the geometry of the accumulator chamber.

63 Claims, 5 Drawing Sheets

MACHINE FOR DIRECT OR INDIRECT APPLICATION OF A LIQUID OR VISCOUS COATING MEDIUM ONTO A MOVING SURFACE

BACKGROUND OF THE INVENTION

1. Field of the Invention

The present invention relates to a machine designed for direct or indirect application of a liquid or viscous coating medium onto a moving surface.

2. Description of the Related Art

Coating machines for direct or indirect application of a liquid or viscous coating medium onto a moving surface are generally well known and considered as state-of-the-art (ref GB 2 040 738 A). In the case of direct application, the moving surface includes an outer surface of a material web such as paper or cardboard. In the case of indirect application, the moving surface includes an outer surface of a transfer element, preferably a transfer roll which transfers the coating medium onto the material web. In order to achieve a uniform coating with such a coating mechanism, a coater must be uniformly supplied with a coating medium. That means that the pressure of the incoming coating medium has to be equally applied onto the coater across the entire coating width so that the coater is uniformly lifted off the moving surface to form a metering slot of the desired width. This applies to the application of a coater blade, as well as to a smooth or profiled coater rod. The "profile" of the coater rod can be generated by way of wire sheathing, machining, etching, or forming of impressions onto its surface.

GB 2 040 738 does not deal with the problem of achieving a uniform coating, but introduces a concept that is capable of compensating for the surface wear of the coater bed supporting the coater rod. It should be further noted that GB 2 040 738 describes the coating medium being supplied to the coater as already having taken the shape of a thin film. An older, re-published document DE 197 23 458 A1 discloses a coating mechanism, which includes an accumulator chamber positioned downstream of the coater, whose boundaries are formed by an accumulator chamber inlet limiting element at the moving surface entrance and a coater at the moving surface exit. The main purpose of the accumulator chamber inlet limiting element is to keep air bubbles from entering the accumulator chamber.

It cannot be discerned from GB 2 040 738 A that the coating quality can be influenced by the accumulator chamber positioned in front of the coater and by altering its geometry. The movement of the limiting surface of the coater facing the moving surface towards the moving surface serves to balance the wear in the intake area of the coater rod. This is only possible because the coating medium is supplied in form of a thin film and does not accumulate or "back up" in front of the coater rod.

In terms of the subject matter, DE 197 213 458 differs by the fact that the accumulator chamber is open on one side; that means it is not bound by an accumulator chamber limiting element.

SUMMARY OF THE INVENTION

The present invention provides a coating mechanism that is capable of uniformly applying a liquid or viscous coating medium onto a moving surface. A machine is designed for direct or indirect application of a liquid or viscous coating medium onto a moving surface. In the case of direct application, the moving surface is an outer surface of a material web, such as paper or cardboard. In the case of indirect application, the moving surface is an outer surface of a transfer element, preferably a transfer roll designed to transfer the coating medium onto a material web. The machine further includes a coating mechanism with a coater bed and a coater, which, together with the moving surface, establish a metering slot.

A limiting surface of the coater positioned at the inlet of the moving surface forms an accumulator chamber designed to accumulate or collect the coating medium transported by the moving surface. This chamber includes an opening at the side of the chamber opposing the feed direction of the moving surface. This chamber gradually decreases in volume in the feed direction of the moving surface. Such a chamber further includes an adjusting mechanism in order to alter the relative position of the limiting surface with respect to the moving surface and to thereby alter the shape of the accumulator chamber.

The present invention has distinct advantages over prior art coating mechanisms. By providing a chamber ahead of the coater in which the coating medium accumulates, a transverse flow patterns builds upstream of the coater, i.e., the flow has components in a direction perpendicular to the moving surface. This cross-flow leads to a more even distribution of the coating medium across the width of the moving surface on one hand, and, on the other hand, to a more balanced pressure distribution of the accumulated coating medium. This has the consequence that the coater receives the coating medium more evenly, resulting in overall improvements in coating quality.

An additional advantage of the accumulator chamber can be realized by changing the geometry of the accumulator chamber by use of an adjusting mechanism. This alters the hydrodynamic pressure in a very specific manner, which, in turn, affects the coating thickness without having to change the feed speed or the viscosity of the coating medium.

When applying a coating mechanism that employs a coater rod, the provision of the accumulator chamber has the further advantage of minimizing the influence of the coater rod diameter, i.e., the surface curvature of the coater rod, on the hydrodynamic pressure acting upon it. More specifically, the combination of a coater rod having a small diameter and a limiting surface designed as described by the present invention can result in conditions that are normally only achievable with very large diameter coater rods. This allows for the advantages of coater rods with small diameters, such as the easier handling, lower manufacturing cost, etc., to be combined with the advantages of large diameter coaters such as the increased amount of coating medium that can be applied onto the moving surface per unit time, as well as the lower pressure being exerted onto the moving surface, etc.

Additionally, when applying the coating mechanism in accordance to the present invention, it requires only a reduced number of coater rods with varying diameters to cover the full operating spectrum of the coating procedure.

Finally, the even distribution of the coating medium in the accumulator chamber, and therefore, the improved pressure distribution in the coating medium, allows the pre-metering amount to be lowered, which, in turn, lowers the total amount of circulating coating medium and, hence, the required pumping power.

It should be noted here that the above mentioned optimization of the operating conditions can be achieved not only with smooth coater rods, but also with profiled coater rods.

An optimum color distribution can be achieved when using jets (for example slotted jets or spray jets, etc.) for the pre-metering of coating films in film presses.

In general, this coating mechanism can be applied in coating equipment, which is commercially available through the corporation of the applicant under the name "Speedsizer", "SpeedCoater" and "SpeedFlow". Further advantages include the capability of achieving targeted shear stresses of the coating medium in the accumulator chamber, as well as the capability of affecting the mold clamping force of the coater bed to avoid color circles on the coater rod or to avoid coater rod vibrations.

The above indicated advantages can be achieved especially when the length of the accumulator chamber, as measured in direction of feed, is between 2 mm and 100 mm, preferably between 5 mm and 50 mm, and/or when the width of the accumulator at the inlet is between 0.5 and approximately 5 mm, preferably between 0.5 mm and approximately 2 mm, as measured in a direction that is perpendicular to the direction of feed as well as perpendicular to the transverse direction of the moving surface. If the feed speed of the moving surface is relatively low, i.e. 900 m/min, an accumulator chamber length that is comparatively large with a relatively small inlet width can be applied. With an average feed speed of approximately 1000 m/min, the accumulator chamber length, as well as the inlet width, can also be mean values. In the case of higher feed speeds, especially when the speeds exceed 1500 m/min, a short accumulator chamber length having a large inlet width can be used. Of course, the above mentioned relative values are in reference to the absolute values of the accumulator length and inlet width stated at the beginning of this paragraph.

If the coating mechanism is further equipped with a distribution chamber adjacent to the inlet of the accumulator chamber, the cross-flows, which are required to balance the pressure in the incoming coating medium, can be kept away from the metering slot by instituting simple design considerations. This further improves the quality of the coating result. With this additional development of the present invention, the pressure balancing occurs initially in the distribution chamber, which is further removed from the metering slot. The coating medium is subsequently fed through the narrower accumulator nip to the metering gap.

The distribution chamber can have a length of between 5 mm and approximately 30 mm, for example, as measured in the direction of feed, and/or an inlet width ranging from approximately 4 mm to 11 mm, as measured in a direction that is perpendicular to the direction of feed as well as perpendicular to the transverse direction of the moving surface.

In order to simplify the altering of the relative position of the limiting surface, which bounds not only the accumulator chamber but also the distribution chamber, the adjusting mechanism can be designed to be capable of simultaneously altering the shape of the accumulator chamber, as well as that of the distribution chamber.

Altering the geometry of the accumulator chamber (and the distribution chamber) can be simply accomplished by adjusting a limiting surface of a coater bed. A coater bed has a base unit onto which the coater is attached, while the limiting surface is part of a tongue plate which is positioned at a distance relative to the base unit while being connected to it in a flexible manner. The adjusting mechanism can support itself on the base unit as well as on the coater bed.

Alternatively, the same effect can be achieved by rotating the coater bed by moving an adjusting mechanism about an axis positioned in the transverse direction relative to the moving surface. If, as an additional measure, the tongue plate is supported at its free end by a support element of the coating mechanism, the approaching and receding movements of the limiting surface of the coater bed at a point along the tongue plate near the coater are amplified as compared to a point along the tongue plate that is further removed from the coater, which, once again, has a favorable impact on the pressure distribution of the coating medium accumulating in the area ahead of the coater.

As an alternative to the above-described options detailing coater bed design and adjustment options, the coater bed can also be attached to a support element of the coating mechanism via a flexible web so that an approach or recession (with respect to the moving surface) of the coater bed surface defining in part the accumulator or distribution chamber can be achieved by moving the coater bed as a whole. The adjusting device can support itself on the coater bed as well as on the support element.

For the above-described design, which employs a coater rod to serve as a coater, the rod can have a diameter of between 10 and 38 mm, preferably approximately 24 mm, which is advantageous as far as handling is concerned.

In a further development of the present invention, at least one section of the adjoining limiting surface can be made flat. In order to achieve an optimum hydrodynamic interaction between the limiting surface and the coater rod, this flat section of the flat limiting surface can be positioned at a distance of up to 1 mm relative to an imaginary plane positioned tangentially to the coater rod and substantially parallel to the flat section of the limiting surface. Additionally, or alternatively, the flat section of the limiting surface can be positioned at an angle of up to 10 degrees relative to an imaginary plane positioned tangentially to the coater rod, allowing a smooth convergence in the accumulator/nip area, and thus avoiding the undesired generation of turbulences in the coating medium.

Additionally, or alternatively to the flat surface section, the limiting surface can also include a section which has the shape of a partial outer surface of a circular cylinder. Specifically, this circular cylinder can have a radius of between 10 mm and 600 mm, preferably approximately 50 mm.

In order to avoid deposits on the limiting surface, at least a part of the surface sections of the limiting surface can be connected by rounded-off transition sections.

As touched upon in a previous section of this text, with a coating mechanism employing a coater rod placed in a cavity of the coater bed in a such a manner that it is allowed to rotate, any changes to the relative position of the limiting surface and moving surface should not affect the support of the coater rod in its seat. This allows an independent adjustment of the coater rod mounting in the rod cavity on one hand and the geometry of the accumulator chamber on the other hand.

In order to facilitate a pressing of the coater rod against the moving surface and in order to be able to fix the position of the coater in the coater bed, an additional adjusting mechanism can be provided, which can be activated independently from the above-described adjusting mechanism. The terminology "fixing the position" in this context describes a measure to secure the coater rod to keep it from falling out. Concurrently, though, it must be assured that the rod is still capable of rotating in its bed.

In order to respond to possible non-uniformities that remain in the coating, it is suggested that the minimum of one adjusting mechanism includes a plurality of adjusting elements distributed in the transverse direction of the machine, all of which are activated independently from each other. The adjusting elements can be activated in at least one of the following manners: electrically, hydraulically, pneumatically, hydro-pneumatically and manually. An especially simple design of the adjusting mechanism can be achieved when at least part of the adjusting elements have pneumatic hose units. Further, in view of achieving a satisfactory coating profile in the transverse direction, at least one adjusting element can contain a pneumatic hose that includes a plurality of individual pressure chambers.

The invention further relates to a process designed to apply a liquid or viscous coating medium onto a moving surface by use of a machine as it is described above. The process allows the coating pressure to be influenced or adjusted by altering the relative position of the limiting surface with respect to the moving surface, that is, by altering the shape or geometry of the accumulator chamber. With respect to the advantages and further development opportunities of this process, reference is made to the aforementioned discussion of the coating mechanism.

It should be especially highlighted here that the process, as described by this invention, lends itself to modify or adjust the transverse profile of the coating that is to be applied onto the moving surface by altering the relative position of the limiting surface with respect to the moving surface in specific zones of the application area.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Figure 1:
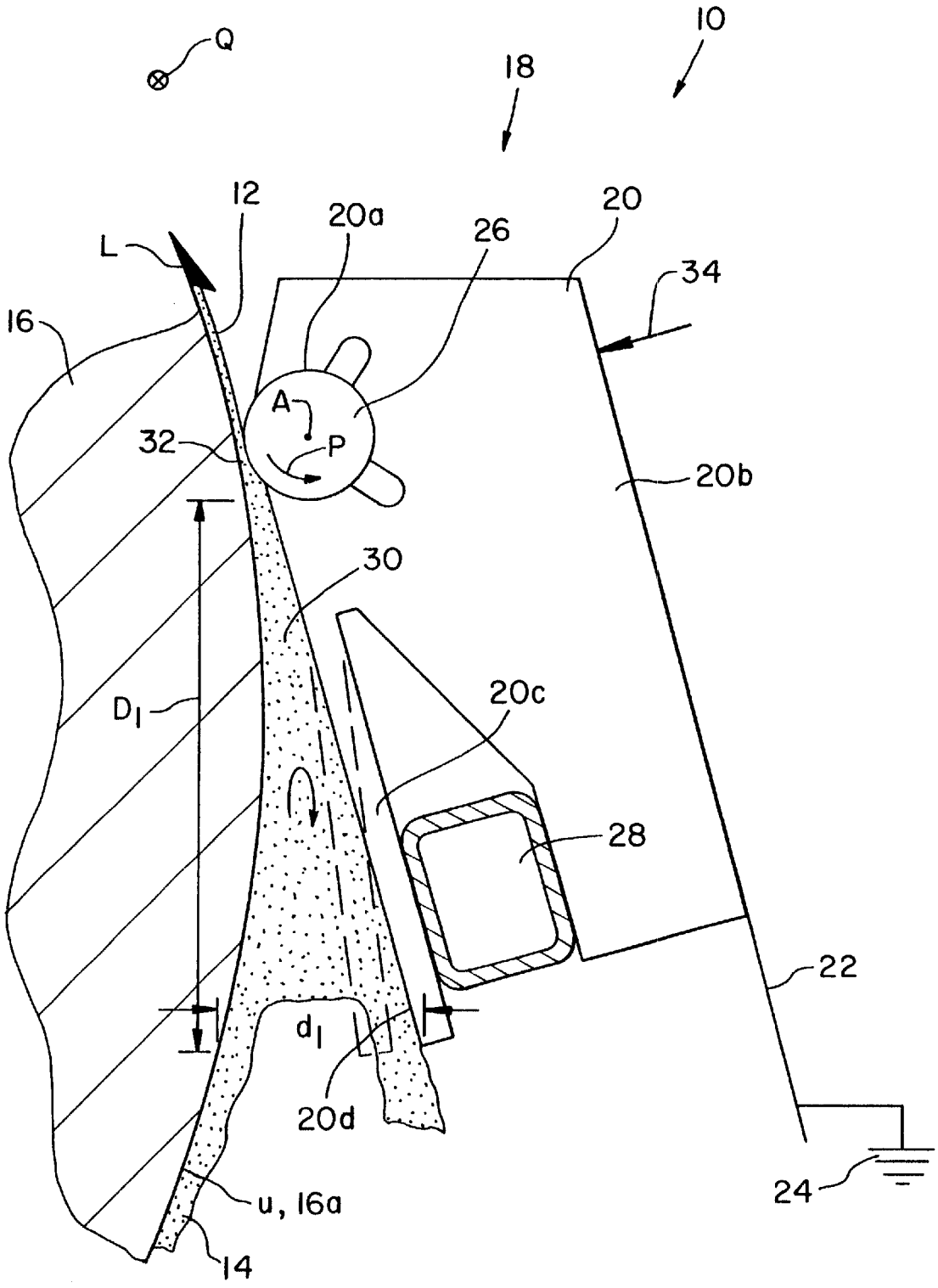
FIG. 1 is schematic, partial cross-sectional side view of a coating mechanism in accordance with this invention.

Corresponding reference characters indicate corresponding parts throughout the several views. The exemplifications set out herein illustrate at least one preferred embodiment of the invention, in one form, and such exemplifications are not to be construed as limiting the scope of the invention in any manner.

DETAILED DESCRIPTION OF THE INVENTION

Referring now to the drawings and particularly to FIG. 1, there is shown a coating mechanism 10 in accordance with the intent of the present invention. It is serves to apply a layer 12 of coating material 14 of uniform thickness onto a moving surface U traversing in direction L. In this case, moving surface U is outer surface 16*a* of a transfer roll 16. Coating medium 14 is applied in excess, although pre-metered, onto roll 16 by use of a coating applicator (not shown) and receives the final metering as well as final smoothing by use of coater 18 (FIG. 1), so that is coating layer 12 receives a uniform thickness in the longitudinal direction L as well as in the transverse direction Q.

Coater 18 includes a coater bed 20, which is fastened to support element 24 of coating machine 10 by support piece 22 (shown only schematically in FIG. 1). Coater rod 26 is seated in a cavity 20*a* of a base unit 20*b*, which is part of coater bed 20, and rotates around its longitudinal axis A which is essentially located parallel to transverse direction Q. Coater rod 26, whose outer surface can either be smooth or profiled, can rotate in the opposite direction with respect to the feed direction L of the moving surface U, i.e., in the direction as indicated by arrow P in FIG. 1.

Upstream of coater rod 26 resides a flexible tongue 20*c* of base unit 20*b*; both of which are an integral part of the coater bed. The flexibility of the tongue is a function of the material properties of the tongue, as well as a function of certain design features. In the example shown in FIG. 1, tongue 20*c* is designed to be relatively slender so the tongue can be pushed against moving surface U by pneumatic pressure hose 28, given the constraints of the elastic deformation capability of the material of coater bed 20. When releasing the pressure from the pneumatic pressure hose 28, the tongue moves away from the moving surface U and returns to its original position as a result of its natural elastic characteristics. Coater rod 26 is supported in such, a manner as to preclude an effect thereon as the pressure in pressure hose 28 fluctuates.

One outer surface 20*d* of tongue 20*c* extends in a direction opposite to the feed direction L of moving surface U to a distance from the coater rod 26 which is specified as $D_1$ and has a proximity of $d_1$ relative to the moving surface U. Because of the protruding design of the tongue, an accumulator chamber 30 is formed by the moving surface U and the surface 20*d* of tongue 20*c* facing the moving surface, in which the coating medium (supplied in excess quantity) accumulates ahead of coater element 26. Coating medium 14 disperses inside this accumulator chamber 30 in transverse direction Q, so that at any place within the working area, a sufficient amount of coating medium 14 is present at coater element 26. Additionally, the hydrodynamic pressure present in accumulated coating medium 14 also equalizes across transverse direction Q. The hydrodynamic pressure conditions are thus substantially identical at any point along coater rod 26, so that metering slot 32 formed by moving surface U and coater rod 26 is substantially uniformly constant across the entire working width, resulting in the desired uniform coating layer 12.

As is known from the state of the art, the width of metering slot 32 is self-adjusting as a result of opposing forces: On one hand, the hydrodynamic pressure present in accumulator chamber 30 attempts to lift coater element 26 including coater bed 20 off from moving surface U. On the other hand, coater rod 26 and coater bed 20 are being forced towards moving surface U by an adjusting mechanism, which is only indicated schematically in FIG. 1 by arrow 34.

Since surface 20*d* of tongue 20*c* separating accumulator chamber 30 from coater bed 20 is relatively large compared to the outer surface of coater rod 26 facing accumulator chamber 30, the pressure acting upon surface 20*d*, forcing a widening of coating gap 32, dominates. The entire pressure loading induced by coating medium 14 and acting upon coater bed 20 is, therefore, essentially independent of the diameter of coater rod 26. This has several advantages:

On one hand, coating mechanism 10 can take advantage of coater rods having small diameters as well as of coater rods with large diameters. This means that it is possible to deliver a large amount of coating medium 14 onto moving surface U per unit time with cost-effective, commercially available, easy-to-handle coater rods. Consequently, the pressure acting upon the moving surface U is relatively low.

On the other hand, the pressure of coating layer 12 can be altered by simply changing the relative position of limiting surface 20*d* with respect to moving surface U, without having to change the force settings of adjusting mechanism 34, designed to force coater rod 26 against moving surface U.

Furthermore, coater 18 requires a reduced number of coater rods with varying diameters to cover the full operating spectrum, compared to traditional coaters, whose hydrodynamic forces attempt to widen metering slot 32 upstream of the coater rod, are largely dependent on the diameter of the coater rod.

Length $D_1$ of accumulator chamber 30 can range between approximately 5 and 100 mm, while a height $d_1$ of the accumulator chamber can range between approximately 0.5 mm and 5 mm, preferably between 0.5 mm and 2 mm. If moving surface U is moving at a low rate of speed, such as at a speed of approximately 900 m/sec, then a long accumulator chamber 30 with a small inlet width should be selected. For medium feed speeds, i.e., approximately 1000 m/sec, a medium-sized accumulator chamber length with a medium sized inlet width is recommended. For high feed speeds, such as speeds in excess of 1500 m/sec, a short accumulator chamber length with a large-sized inlet width is suggested.

Figure 1A:
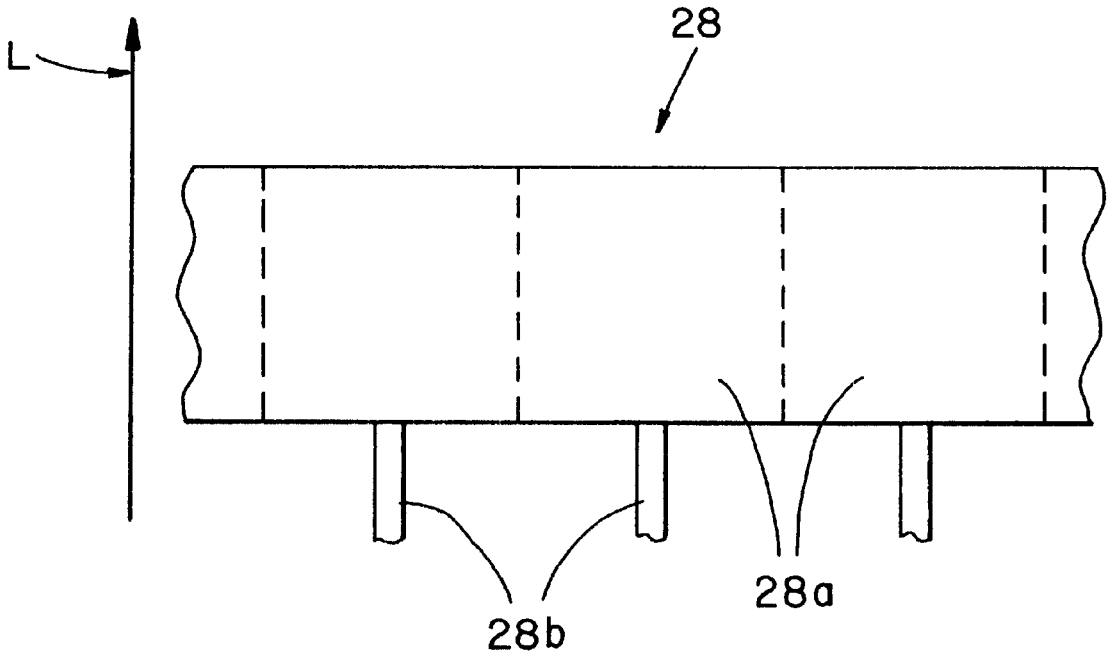
FIG. 1*a* is a schematic partial view of a pressure hose with a plurality of individual pressure chambers.

It should be mentioned here that pressure hose 28 is supported on base unit 20*b* of coater bed 20 for adjusting purposes. As schematically shown in FIG. 1*a*, pressure hose 28 can be sectioned into a plurality of individual pressure chambers 28*a*, which are independently provided with a pressurized medium such as air via pressure lines 28*b*. The sectioning of the pressure hose allows the adjustment of height $d_1$ of accumulator chamber 30 at various places along the width of the machine, facilitating a transverse profiling of coating 12.

A further advantage of coater 18 can be realized by allowing the thickness of coating 12 to be altered through changing height $d_1$ of accumulator chamber 12. This eliminates the need of having to change the feed speed of moving surface U traversing in feed direction L, or of having to change the viscosity of coating medium 14 for the purpose of achieving a different coating thickness. Coater 18 introduces an additional and quick process to alter the thickness of coating 12.

Figure 2:
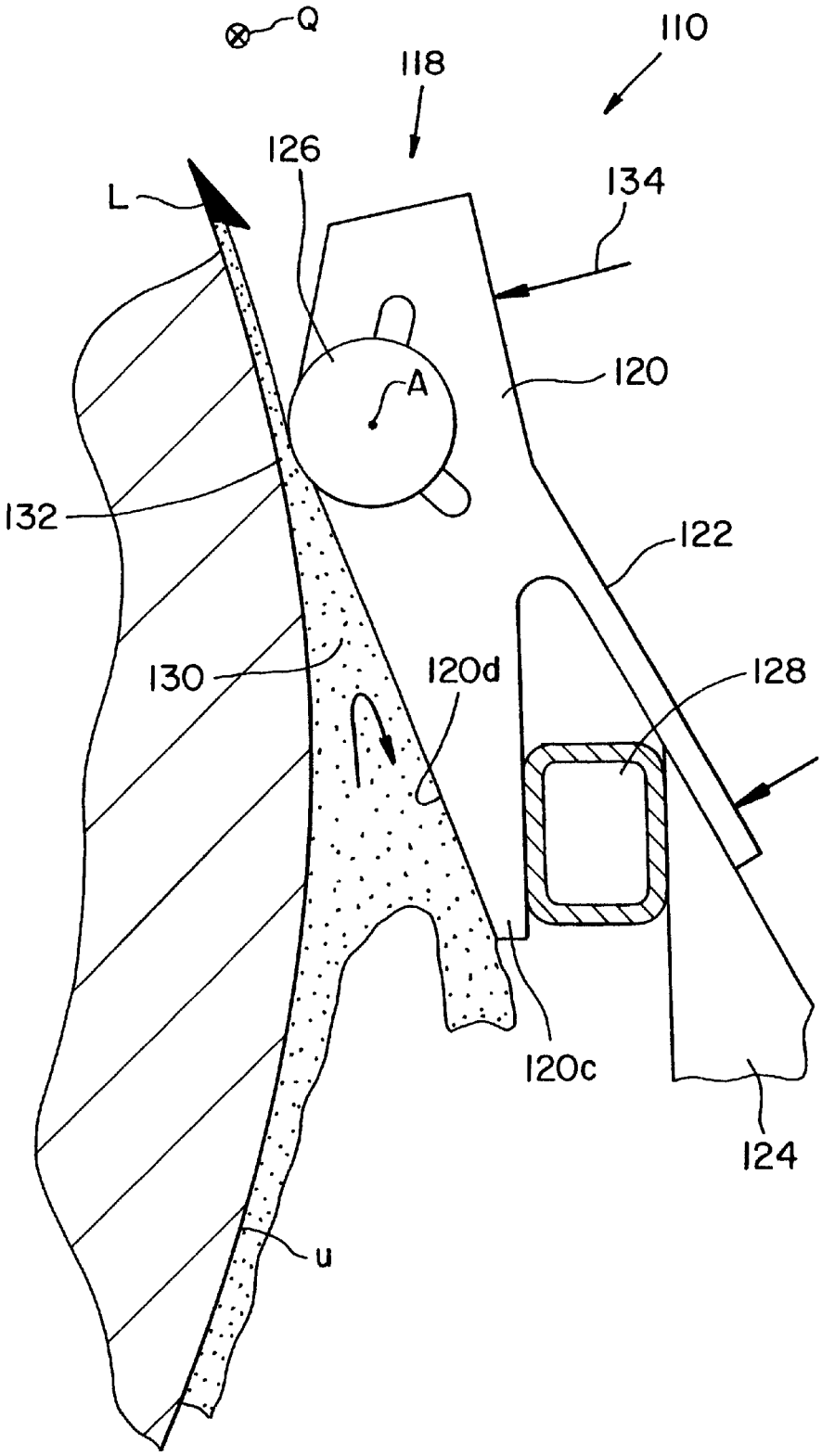
FIGS. 2–4 are illustrations in the same fashion as shown in FIG. 1 of additional designs.

FIG. 2 illustrates another design variation of coating mechanism presented by this invention. It is fundamentally similar to the coater mechanism represented in FIG. 1. The same parts use the same reference labels as used in FIG. 1 but are increased by the number 100. It should also be pointed out that the description of coating machine 110 displayed in FIG. 2 is limited to the differences between the two designs.

The coater 118 of the design shown in FIG. 2 differs from the coater 18 shown in FIG. 1 mainly by the fact that coater bed 120 of FIG. 2 does not include a tongue 20*c*.

Web 122, required to mount the coater bed 120 onto support element 124, is designed to be sufficiently flexible and is mounted on coater bed 120 in such a manner, that coater bed 120 pivots around an axis parallel to transverse direction Q, as a result of pressure applied to pressure hose 128 which is supported by support element 124.

Coater bed 120 includes a "protruding lip" 120*c*, extending in opposite direction of feed direction L, onto which pressure hose 120 acts upon, and whose surface 120*d* facing moving surface U together with moving surface U, forms accumulator chamber 130. Through clever design of coater bed 120, mounting web 122, as well as pressure hose 128, it is feasible to locate the axis, around which coater bed 120 pivots upon applying pressurized gas to pressure hose 128, to a position which is identical to the position of the axis associated with coater rod 126. This has the advantage that the width of metering slot 132 does not fundamentally change when altering the geometry of accumulator chamber 130 and has the additional advantage that the adjusting force of adjusting mechanism 134 is not biased in significant ways.

Figure 3:
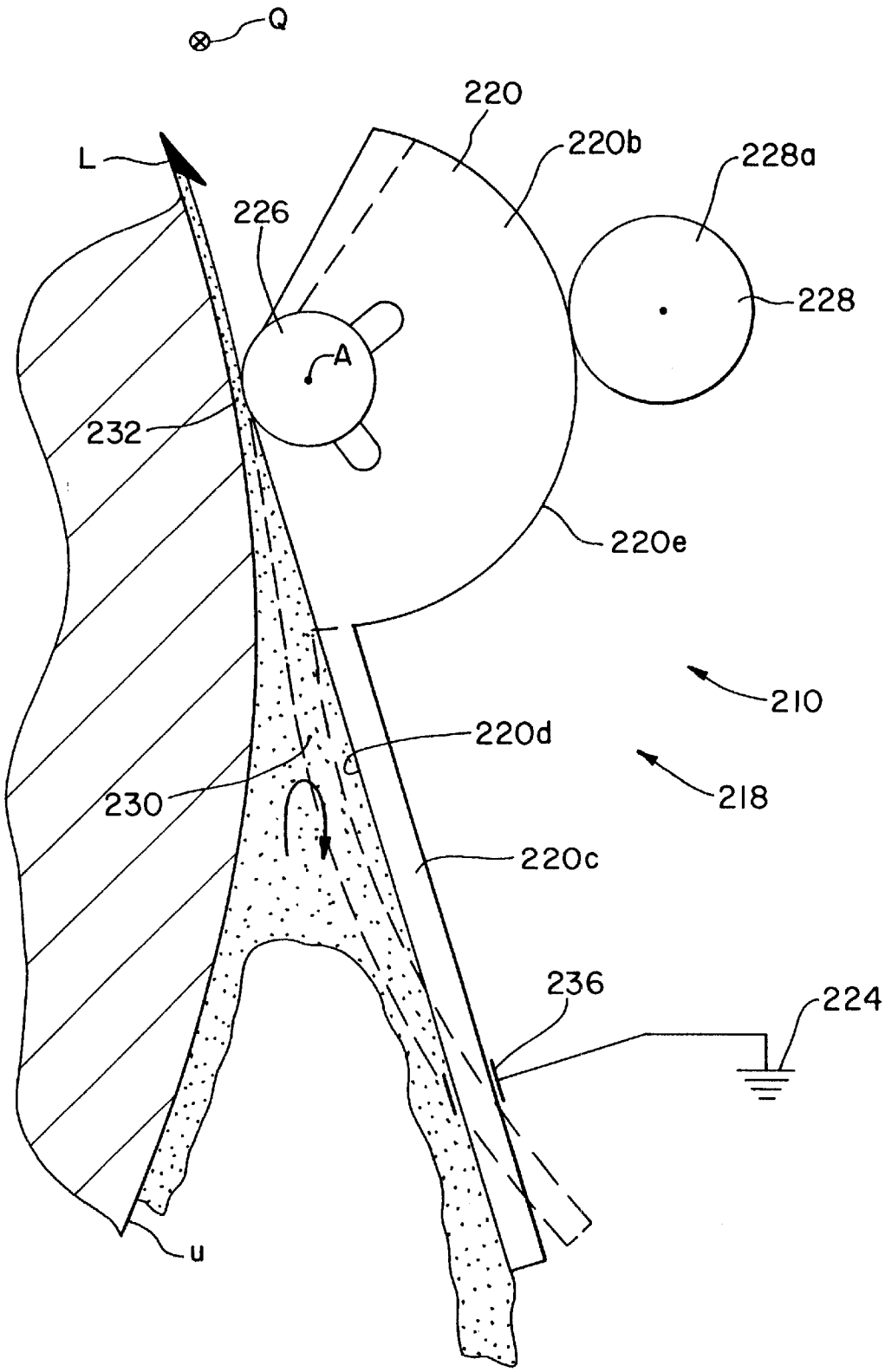

FIG. 3 illustrates another design variation of the present invention, which corresponds, in essence, to the designs displayed in FIGS. 1 and 2. The same parts use the same reference labels as used in FIGS. 1 and 2 but are increased by the number 200, compared to the reference numbers used in FIG. 1. It should also be pointed out that the description of coating machine 210 displayed in FIG. 3 is limited to the differences between it and the designs shown in FIGS. 1 and 2.

Coating mechanism 210 shown in FIG. 3 utilizes coater bed 220 of coater 218 designed and supported in a manner that allows base unit 220*b* to be rotated around the axis A of coater rod 226. To facilitate this motion, gear teeth 220*e* are integrated into coater rod bed 220 engaging with gear 228*a* of adjusting mechanism 228.

Base unit 220*b* of coater bed 220 includes a tongue 220*c* designed in a similar fashion to the construction shown in FIG. 1. Tongue surface 220*d* (facing moving surface U) together with moving surface U bounds accumulator chamber 230. Tongue 220*c* does not necessarily have to be designed to be flexible, since a fixed tongue 220*c* is just as suitable to be moved to and from moving surface U by use of drive mechanism 228. In the construction shown in FIG. 3, however, tongue 220*c* is designed to be flexible and is mounted by support arrangement 236 onto support element 224 of coating machine 210. Support arrangement 236 can be attached to support element 224 in a fixed or movable manner.

By supporting tongue 220*c* of coater bed 220, tongue 220 undergoes a bending as,it is moved towards moving surface U in response to an adjustment of adjusting mechanism 228, so that the section of surface $\mathbf{220}_d$ bounding the accumulator chamber comes closer to moving surface U, as compared to a section of surface 220*d* that is further removed from metering slot 232. This can have a favorable impact on the hydrodynamic pressure conditions in accumulator chamber 230.

Figure 4:
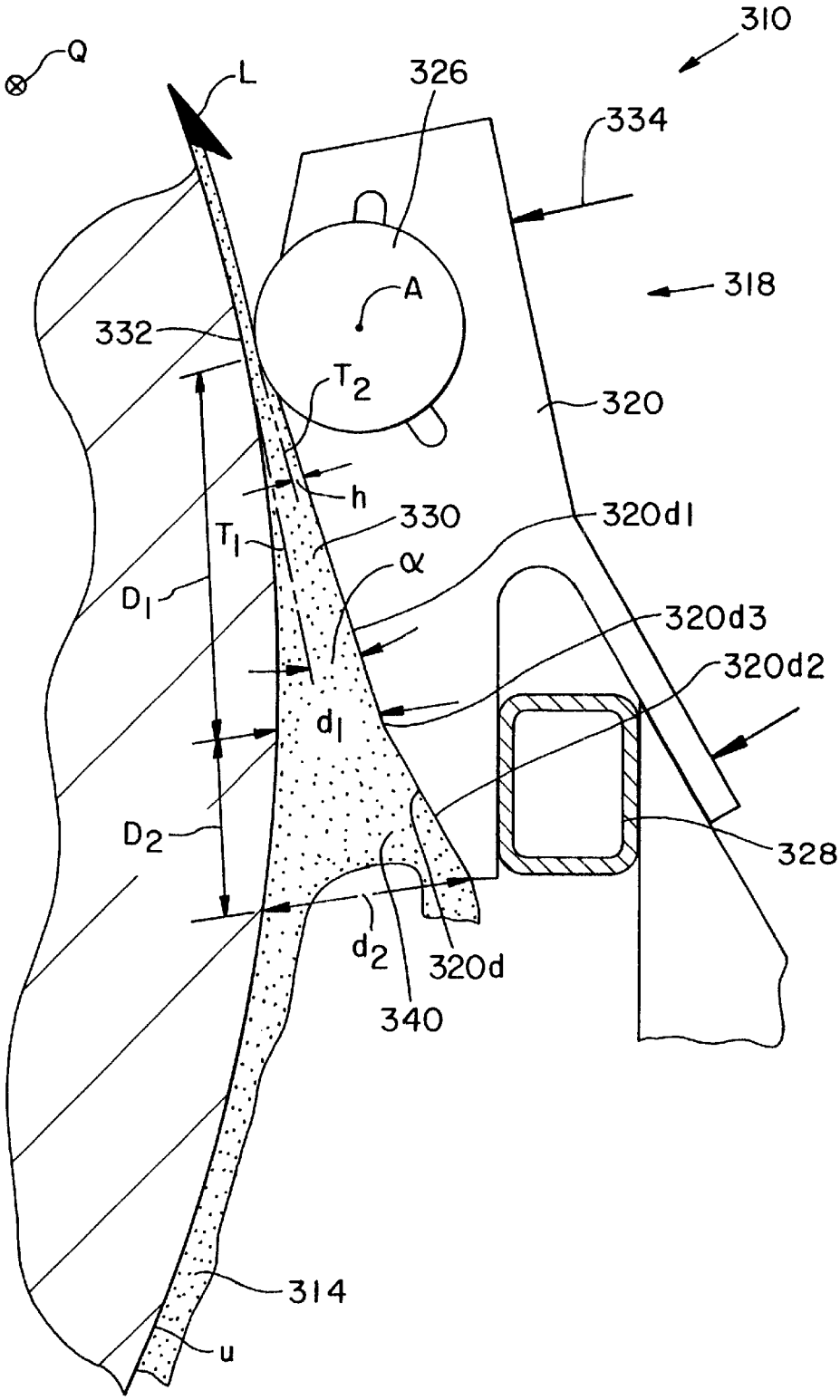

FIG. 4 illustrates another design variation of the present invention, which corresponds, in essence, to the design displayed in FIG. 2. The same parts use the same reference labels as used in FIG. 2, but are increased by the number 200, compared to the reference numbers used in FIG. 2, or increased by the number 300 as compared to the reference numbers used in FIG. 1. It should also be pointed out that the description of coating machine 310 displayed in FIG. 4 is limited to the differences between it and the designs shown in FIGS. 1 through 3.

Coater 318 of coating machine 310 shown in FIG. 4 differs from coating mechanism 118 shown in FIG. 2 only by the addition of a distribution chamber 340 upstream of accumulator chamber 330, whose taper in direction opposite of the feed direction L is more pronounced as compared to accumulator chamber 330. For example, distribution chamber 340 can have length $D_2$ ranging from approximately 5 to 30 mm and an inlet width $d_2$ ranging from approximately 4 to 11 mm.

The wide distribution chamber 340 of the design shown in FIG. 4 serves to evenly distribute coating medium 314, as well as to distribute the hydrodynamic pressure present in the coating medium in transverse direction Q of moving surface U. Coating medium 314 subsequently passes through narrow accumulator chamber 330 into metering slot 332, at which point it has a uniform flow pattern, resulting in improved coating quality.

Accumulator chamber 330, as well as distribution chamber 340, is bound by surface 320*d* of coater bed 320. Surface 230*d* includes a first section 320*d*1, which is part of accumulator chamber 330, and a second section 320*d*2, residing closer to pressure hose 328, which is part of distribution chamber 340. In order to simplify the design of coating mechanism 310, as well as to simplify the controls aspect of the adjusting mechanism, the design is such that pressure hose 328 affects the position of both surface sections 320*d*1 and 320*d*2 relative to moving surface U simultaneously.

In order that coating medium 314 does not adhere to surface 320*d*, the transition between two surface sections 320*d*1 and 320*d*2 is rounded in the area labeled as 320*d*3 instead of being a sharp edge. This design feature should also be applied to other areas of coating machine 310 for similar reasons.

Finally, it should be pointed out that limiting surfaces 20*d*, 120*d*, 220*d* and surface section 320*d*1 of all design variations depicted in FIGS. 1 through 4 are flat, at least at their end regions bordering the coater rod.

As FIG. 4 shows in form of an example, which is also applicable for the remaining Figures, flat surface section 320*d*1 is positioned at an angle of up to 10 degrees relative to an imaginary plane $T_1$ located tangentially to moving surface U at metering slot 332. The resulting, relatively narrow nip of accumulator chamber 330 provides an effective manner in which to distribute and feed coating medium 314 to metering slot 332.

Additionally, this surface section is placed at a distance of no more than 1 mm (distance h) from another imaginary plane T2, which is located tangentially to coater rod 326 at metering slot 332. This means that flat surface section 320*d*1 is nearly tangential to coater rod 326, so that the outer surface of coater rod 326 and the adjacent flat surface section 320*d*1 form one unit which acts like a coater rod having a large diameter.

All this has a favorable impact on the coating quality. Because of the effectiveness of the accumulator chamber, designed per the intent of the present invention, and the adjacent distribution chamber, coater rods of small diameters can be utilized and more coating medium can be applied per unit time. At the same time a uniform coating quality can be achieved.

Furthermore, it should be mentioned here that not only can a curved limiting surface be employed, as shown in FIG. 3, but one can also employ a limiting surface designed in accordance to the illustrations in FIGS. 1, 2 and 4, that is inherently curved. Specifically, the curvature can have a approximate range in radius of between 10 mm and 600 mm, preferably 50 mm.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A coating device for directly applying a coating medium onto a fiber material web, said coating device comprising:

a coater including a coater bed and a coater rod, said coater rod being rotatably mounted to said coater bed and configured for being positioned adjacent the web, said coater rod configured to define with the web a metering slot therebetween, said coater bed further comprising a limiting surface at an inlet thereof, said limiting surface being configured such that said limiting surface and the web define an accumulator chamber therebetween, said accumulator chamber opening in a direction opposite to a feed direction of the web and gradually decreasing in volume in the feed direction, said accumulator chamber being configured to promote accumulation of the coating medium in a region ahead of said metering slot relative to the feed direction, said limiting surface and an inlet side of said accumulator chamber together being configured to define with the web a distribution chamber therebetween; and an adjusting mechanism positioned adjacent to said coater bed and configured to alter the relative position of said limiting surface with respect to the web and to thereby alter a geometry of said accumulator chamber.

2. The coating device of claim 1, wherein said distribution chamber has a length of between 5 mm and 30 mm, as measured in the feed direction.

3. The coating device of claim 1, wherein said distribution chamber has a width at said inlet of between approximately 4 mm and 11 mm, as measured in a direction that is perpendicular to both the feed direction and a transverse direction of the moving surface.

4. The coating device of claim 1, wherein said adjusting mechanism is configured to simultaneously alter both said geometry of said accumulator chamber and a geometry of said distribution chamber.

5. A coating device for directly applying a coating medium onto a fiber material web, said coating device comprising:

a coater including a coater bed and a coater rod, said coater rod being rotatably mounted to said coater bed and configured for being positioned adjacent the web, said coater rod configured to define with the web a metering slot therebetween, said coater bed further comprising a limiting surface at an inlet thereof, said limiting surface being configured such that said limiting surface and the web define an accumulator chamber therebetween, said accumulator chamber opening in a direction opposite to a feed direction of the web and gradually decreasing in volume in the feed direction, said accumulator chamber being configured to promote accumulation of the coating medium in a region ahead of said metering slot relative to the feed direction, said coater bed further comprising a base unit onto which said coater rod is mounted and a tongue plate positioned at a distance from said base unit and flexibly connected thereto, said limiting surface being a part of said tongue plate; and an adjusting mechanism positioned adjacent to said coater bed and configured to alter the relative position of said limiting surface with respect to the web and to thereby alter a geometry of said accumulator chamber.

6. The coating device of claim 5, wherein said adjusting mechanism is supported on one side by said tongue plate at a side thereof opposite to said limiting surface and on another side by said base unit.

7. The coating device of claim 5, wherein said adjusting mechanism is configured to pivot said coater bed about an axis that is substantially parallel to a direction transverse to the feed direction.

8. The coating device of claim 5, wherein said tongue is supported by a support element of said coating device.

9. A coating device for directly applying a coating medium onto a fiber material web, said coating device comprising:

a coater including a coater bed and a coater rod, said coater rod being rotatably mounted to said coater bed and configured for being positioned adjacent the web, said coater rod configured to define with the web a metering slot therebetween, said coater bed further comprising a limiting surface at an inlet thereof, said limiting surface being configured such that said limiting surface and the web define an accumulator chamber therebetween, said accumulator chamber opening in a direction opposite to a feed direction of the web and gradually decreasing in volume in the feed direction, said accumulator chamber being configured to promote accumulation of the coating medium in a region ahead of said metering slot relative to the feed direction, said coater bed being connected to a support element of said coating device via a flexible web; and an adjusting mechanism positioned adjacent to said coater bed and configured to alter the relative position of said limiting surface with respect to the web and to thereby alter a geometry of said accumulator chamber.

10. The coating device of claim 9, wherein said adjusting mechanism is supported by said coater bed on one side and by said support element on another side.

11. A coating device for directly applying a coating medium onto a fiber material web, said coating device comprising:

a coater including a coater bed and a coater rod, said coater rod being rotatably mounted to said coater bed and configured for being positioned adjacent the web, said coater rod configured to define with the web a metering slot therebetween, said coater bed further comprising a limiting surface at an inlet thereof, said limiting surface being configured such that said limiting surface and the web define an accumulator chamber therebetween, said accumulator chamber opening in a direction opposite to a feed direction of the web and gradually decreasing in volume in the feed direction, said accumulator chamber being configured to promote accumulation of the coating medium in a region ahead of said metering slot relative to the feed direction, said limiting surface being comprised of a section having a shape of a partial outer surface of a cylinder; and an adjusting mechanism positioned adjacent to said coater bed and configured to alter the relative position of said limiting surface with respect to the web and to thereby alter a geometry of said accumulator chamber.

12. The coating device of claim 11, wherein said cylinder has a radius in the range of approximately 10 mm to 600 mm.

13. The coating device of claim 12, wherein said radius is approximately 50 mm.

14. A coating device for directly applying a coating medium onto a fiber material web, said coating device comprising:

a coater including a coater bed and a coater rod, said coater rod being rotatably mounted to said coater bed and configured for being positioned adjacent the web, said coater rod configured to define with the web a metering slot therebetween, said coater bed further comprising a limiting surface at an inlet thereof, said limiting surface being configured such that said limiting surface and the web define an accumulator chamber therebetween, said accumulator chamber opening in a direction opposite to a feed direction of the web and gradually decreasing in volume in the feed direction, said accumulator chamber being configured to promote accumulation of the coating medium in a region ahead of said metering slot relative to the feed direction, said limiting surface being comprised of a plurality of sections and at least two of said plurality of limiting surface sections are connected by rounded-off transition sections; and an adjusting mechanism positioned adjacent to said coater bed and configured to alter the relative position of said limiting surface with respect to the web and to thereby alter a geometry of said accumulator chamber.

15. A coating device for directly applying a coating medium onto a fiber material web, said coating device comprising:

a coater including a coater bed and a coater rod, said coater rod being rotatably mounted to said coater bed and configured for being positioned adjacent the web, said coater rod configured to define with the web a metering slot therebetween, said coater bed further comprising a limiting surface at an inlet thereof, said limiting surface being configured such that said limiting surface and the web define an accumulator chamber therebetween, said accumulator chamber opening in a direction opposite to a feed direction of the web and gradually decreasing in volume in the feed direction, said accumulator chamber being configured to promote accumulation of the coating medium in a region ahead of said metering slot relative to the feed direction, said coater rod being rotatably supported by a coater rod support inside a cavity within said coater bed; and an adjusting mechanism positioned adjacent to said coater bed and configured to alter the relative position of said limiting surface with respect to the web and to thereby alter a geometry of said accumulator chamber, said limiting surface and said adjusting mechanism being configured to interact in a manner so that there is no effect of any changes to the position of said limiting surface relative to the web on said coater rod support inside said cavity.

16. The coating device of claim 15, wherein a length of said accumulator chamber as measured in the feed direction is between 2 mm and 100 mm.

17. The coating device of claim 16, wherein said length of said accumulator chamber is between 5 mm and 50 mm.

18. The coating device of claim 15, wherein a width of said accumulator chamber at said inlet is between b 0.5and approximately 5 mm, as measured in a direction that is perpendicular to both the feed direction and a transverse direction of the web.

19. The coating device of claim 18, wherein said width of said accumulator chamber is between 0.5 and approximately 2 mm.

20. The coating device of claim 15, wherein said coating rod has a surface that is one of smooth and profiled.

21. The coating device of claim 15, in said coating rod has a diameter within the range of approximately 10 mm to 38 mm.

22. The coating device of claim 21, wherein said coating rod diameter is approximately 24 mm.

23. The coating device of claim 15, wherein at least one section of said limiting surface adjacent to said coater rod is substantially flat.

24. The coating device of claim 23, wherein at least one of said at least one limiting surface sections is placed at a distance of up to 1 mm from an imaginary plane positioned tangentially to said coater rod and parallel to said at least one of said at least one limiting surface sections.

25. The coating device of claim 23, wherein said at least one flat limiting surface section is positioned at an angle of up to 10 degrees relative to an imaginary plane positioned tangentially to the moving surface at said metering slot.

26. A coating device for directly applying a coating medium onto a fiber material web, said coating device comprising:

a coater including a coater bed and a coater rod, said coater rod being rotatably mounted to said coater bed and configured for being positioned adjacent the web, said coater rod configured to define with the web a metering slot therebetween, said coater bed further comprising a limiting surface at an inlet thereof, said limiting surface being configured such that said limiting surface and the web define an accumulator chamber therebetween, said accumulator chamber opening in a direction opposite to a feed direction of the web and gradually decreasing in volume in the feed direction, said accumulator chamber being configured to promote accumulation of the coating medium in a region ahead of said metering slot relative to the feed direction, said coater rod being rotatably supported by a coater rod support inside a cavity within said coater bed, an adjusting mechanism positioned adjacent to said coater bed and configured to alter the relative position of said limiting surface with respect to the web and to thereby alter a geometry of said accumulator chamber, said limiting surface and said adjusting mechanism being configured to interact in a manner so that there is no effect of any changes to the position of said limiting surface relative to web on said coater rod support inside said cavity; and a second adjusting mechanism configured to at least one of force said coater against the moving surface and fix a position of said coater rod in said coater bed.

27. A coating device for directly applying a coating medium onto a fiber material web, said coating device comprising:

a coater including a coater bed and a coater rod, said coater rod being rotatably mounted to said coater bed and configured for being positioned adjacent the web, said coater rod configured to define with the web a metering slot therebetween, said coater bed further comprising a limiting surface at an inlet thereof, said limiting surface being configured such that said limiting surface and the web define an accumulator chamber therebetween, said accumulator chamber opening in a direction opposite to a feed direction of the web and gradually decreasing in volume in the feed direction, said accumulator chamber being configured to promote accumulation of the coating medium in a region ahead of said metering slot relative to the feed direction; and a plurality of adjusting mechanisms positioned adjacent to said coater bed and configured to alter the relative position of said limiting surface with respect to the web and to thereby alter a geometry of said accumulator chamber such that the rate at which the volume of flow decreases is altered, said plurality of said adjusting mechanisms being distributed along a direction transverse to the feed direction and configured to be independently activated relative to one another.

28. The coating device of claim 27, wherein said plurality of said adjusting mechanisms are configured to be activated at least one of electrically, hydraulically, pneumatically, hydro-pneumatically, and manually.

29. The coating device of claim 27, wherein at least one of said plurality of said adjusting mechanisms comprises a pressure hose.

30. The coating device of claim 27, wherein said plurality of said adjusting mechanisms is comprised of a pressure hose sectioned into a plurality of chambers.

31. A coating device for indirectly applying a coating medium onto a fiber material web, said coating device comprising:

a coater including a coater bed and a coater rod, said coater rod being rotatably mounted to said coater bed and configured for being positioned adjacent a moving surface, said coater rod configured to define with the moving surface a metering slot therebetween, the moving surface comprising an outer surface of a transfer element for transferring the coating medium onto the web; said coater bed further comprising a limiting surface at an inlet thereof, said limiting surface being configured such that said limiting surface and the moving surface define an accumulator chamber therebetween, said accumulator chamber opening in a direction opposite to a feed direction of the moving surface and gradually decreasing in volume in the feed direction, said accumulator chamber being configured to promote accumulation of the coating medium in a region ahead of said metering slot relative to the feed direction, said limiting surface and an inlet side of said accumulator chamber together are configured to define with the moving surface a distribution chamber therebetween; and an adjusting mechanism positioned adjacent to said coater bed and configured to alter the relative position of said limiting surface with respect to the moving surface and to thereby alter a geometry of said accumulator chamber such that the rate at which the volume decreases in the feed direction is altered.

32. The coating device of claim 31, wherein said distribution chamber has a length of between 5 mm and 30 mm, as measured in the feed direction.

33. The coating device of claim 31, wherein said distribution chamber has a width at said inlet of between approximately 4 mm and 11 mm, as measured in a direction that is perpendicular to both the feed direction and a transverse direction of the moving surface.

34. The coating device of claim 31, wherein said adjusting mechanism is configured to simultaneously alter both said geometry of said accumulator chamber and a geometry of said distribution chamber.

35. A coating device for indirectly applying a coating medium onto a fiber material web, said coating device comprising:

a coater including a coater bed and a coater rod, said coater bed including a base unit onto which said coater rod is mounted and a tongue plate positioned at a distance from said base unit and flexibly connected thereto, said coater rod being rotatably mounted to said coater bed and configured for being positioned adjacent a moving surface, said coater rod configured to define with the moving surface a metering slot therebetween, the moving surface comprising an outer surface of a transfer element for transferring the coating medium onto the web; said coater bed further comprising a limiting surface at an inlet thereof, said limiting surface being a part of said tongue plate, said limiting surface being configured such that said limiting surface and the moving surface define an accumulator chamber therebetween, said accumulator chamber opening in a direction opposite to a feed direction of the moving surface and gradually decreasing in volume in the feed direction, said accumulator chamber being configured to promote accumulation of the coating medium in a region ahead of said metering slot relative to the feed direction; and an adjusting mechanism positioned adjacent to said coater bed and configured to alter the relative position of said limiting surface with respect to the moving surface and to thereby alter a geometry of said accumulator chamber such that the rate at which the volume decreases in the feed direction is altered.

36. The coating device of claim 35, wherein said adjusting mechanism is supported on one side by said tongue plate at a side thereof opposite to said limiting surface and on another side by said base unit.

37. The coating device of claim 35, wherein said adjusting mechanism is configured to pivot said coater bed about an axis that is substantially parallel to a direction transverse to the feed direction.

38. The coating device of claim 35, wherein said tongue is supported by a support element of said coating device.

39. A coating device for indirectly applying a coating medium onto a fiber material web, said coating device comprising:

a coater including a coater bed and a coater rod, said coater bed being connected to a support element of said coating device via flexible web said coater rod being rotatably mounted to said coater bed and configured for being positioned adjacent a moving surface, said coater rod configured to define with the moving surface a metering slot therebetween, the moving surface comprising an outer surface of a transfer element for transferring the coating medium onto the web; said coater bed further comprising a limiting surface at an inlet thereof, said limiting surface being configured such that said limiting surface and the moving surface define an accumulator chamber therebetween, said accumulator chamber opening in a direction opposite to a feed direction of the moving surface and gradually decreasing in volume in the feed direction, said accumulator chamber being configured to promote accumulation of the coating medium in a region ahead of said metering slot relative to the feed direction; and an adjusting mechanism positioned adjacent to said coater bed and configured to alter the relative position of said limiting surface with respect to the moving surface and to thereby alter a geometry of said accumulator chamber such that the rate at which the volume decreases in the feed direction is altered.

40. The coating device of claim 39, wherein said adjusting mechanism is supported by said coater bed on one side and by said support element on another side.

41. A coating device for indirectly applying a coating medium onto a fiber material web, said coating device comprising:

a coater including a coater bed and a coater rod, said coater rod being rotatably mounted to said coater bed and configured for being positioned adjacent a moving surface, said coater rod configured to define with the moving surface a metering slot therebetween, the moving surface comprising an outer surface of a transfer element for transferring the coating medium onto the web; said coater bed further comprising a limiting surface at an inlet thereof, said limiting surface being configured such that said limiting surface and the moving surface define an accumulator chamber therebetween, said accumulator chamber opening in a direction opposite to a feed direction of the moving surface and gradually decreasing in volume in the feed direction, said accumulator chamber being configured to promote accumulation of the coating medium in a region ahead of said metering slot relative to the feed direction, said limiting surface being comprised of a section having a shape of a partial outer surface of a cylinder; and an adjusting mechanism positioned adjacent to said coater bed and configured to alter the relative position of said limiting surface with respect to the moving surface and to thereby alter a geometry of said accumulator chamber.

42. The coating device of claim 41, wherein said cylinder has a radius in the range of approximately 10 mm to 600 mm.

43. The coating device of claim 42, wherein said radius is approximately 50 mm.

44. A coating device for indirectly applying a coating medium onto a fiber material web, said coating device comprising:

a coater including a coater bed and a coater rod, said coater rod being rotatably mounted to said coater bed and configured for being positioned adjacent a moving surface, said coater rod configured to define with the moving surface a metering slot therebetween, the moving surface comprising an outer surface of a transfer element for transferring the coating medium onto the web; said coater bed further comprising a limiting surface at an inlet thereof, said limiting surface being configured such that said limiting surface and the moving surface define an accumulator chamber therebetween, said accumulator chamber opening in a direction opposite to a feed direction of the moving surface and gradually decreasing in volume in the feed direction, said accumulator chamber being configured to promote accumulation of the coating medium in a region ahead of said metering slot relative to the feed direction, said limiting surface being comprised of a plurality of sections, at least two of said plurality of limiting surface sections being connected by rounded-off transition sections; and an adjusting mechanism positioned adjacent to said coater bed and configured to alter the relative position of said limiting surface with respect to the moving surface and to thereby alter a geometry of said accumulator chamber.

45. A coating device for indirectly applying a coating medium onto a fiber material web, said coating device comprising:

a coater including a coater bed and a coater rod, said coater rod being rotatably mounted to said coater bed and configured for being positioned adjacent a moving surface, said coater rod configured to define with the moving surface a metering slot therebetween, the moving surface comprising an outer surface of a transfer element for transferring the coating medium onto the web; said coater bed further comprising a limiting surface at an inlet thereof, said limiting surface being configured such that said limiting surface and the moving surface define an accumulator chamber therebetween, said accumulator chamber opening in a direction opposite to a feed direction of the moving surface and gradually decreasing in volume in the feed direction, said accumulator chamber being configured to promote accumulation of the coating medium in a region ahead of said metering slot relative to the feed direction, said coater rod being rotatably supported by a coater rod support inside a cavity within said coater bed; and an adjusting mechanism positioned adjacent to said coater bed and configured to alter the relative position of said limiting surface with respect to the moving surface and to thereby alter a geometry of said accumulator chamber, said limiting surface and said adjusting mechanism being configured to interact in a manner so that there is no effect of any changes to the position of said limiting surface relative to the moving surface on said coater rod support inside said cavity.

46. The coating device of claim 45, wherein a length of said accumulator chamber as measured in the feed direction is between 2 mm and 100 mm.

47. The coating device of claim 46, wherein said length of said accumulator chamber is between 5 mm and 50 mm.

48. The coating device of claim 45, wherein a width of said accumulator chamber at said inlet is between 0.5 and approximately 5 mm, as measured in a direction that is perpendicular to both the feed direction and a transverse direction of the moving surface.

49. The coating device of claim 48, wherein said width of said accumulator chamber is between 0.5 and approximately 2 mm.

50. The coating device of claim 45, wherein said coating rod has a surface that is one of smooth and profiled.

51. The coating device of claim 45, wherein said coating rod has a diameter within the range of approximately 10 mm to 38 mm.

52. The coating device of claim 51, wherein said coating rod diameter is approximately 24 mm.

53. The coating device of claim 45, wherein at least one section of said limiting surface adjacent to said coater rod is substantially flat.

54. The coating device of claim 53, wherein at least one of said at least one limiting surface sections is placed at a distance of up to 1 mm from an imaginary plane positioned tangentially to said coater rod and parallel to said at least one of said at least one limiting surface sections.

55. The coating device of claim 53, wherein said at least one flat limiting surface section is positioned at an angle of up to 10 degrees relative to an imaginary plane positioned tangentially to the moving surface at said metering slot.

56. The coating device of claim 45, the moving surface comprising a transfer element for subsequently transferring the coating medium onto a material web, said coating device thereby defining an indirect coating device.

57. A coating device for indirectly applying a coating medium onto a fiber material web, said coating device comprising:

a coater including a coater bed and a coater rod, said coater rod being rotatably mounted to said coater bed and configured for being positioned adjacent a moving surface, said coater rod configured to define with the moving surface a metering slot therebetween, the moving surface comprising an outer surface of a transfer element for transferring the coating medium onto the web; said coater bed further comprising a limiting surface at an inlet thereof, said limiting surface being configured such that said limiting surface and the moving surface define an accumulator chamber therebetween, said accumulator chamber opening in a direction opposite to a feed direction of the moving surface and gradually decreasing in volume in the feed direction, said accumulator chamber being configured to promote accumulation of the coating medium in a region ahead of said metering slot relative to the feed direction, said coater rod being rotatably supported by a coater rod support inside a cavity within said coaster bed, an adjusting mechanism positioned adjacent to said coater bed and configured to alter the relative position of said limiting surface with respect to the moving surface and to thereby alter a geometry of said accumulator chamber, said limiting surface an said adjusting mechanism being configured to interact ina manner so that there is no effect of any changes to the position of said limiting surface relative to the web on said coater rod support inside said cavity; and a second adjusting mechanism configured to at least one of force said coater against the moving surface and fix a position of said coater rod in said coater bed.

58. A coating device for indirectly applying a coating medium onto a fiber material web, said coating device comprising:

a coater including a coater bed and a coater rod, said coater rod being rotatably mounted to said coater bed and configured for being positioned adjacent a moving surface, said coater rod configured to define with the moving surface a metering slot therebetween, the moving surface comprising an outer surface of a transfer element for transferring the coating medium onto the web; said coater bed further comprising a limiting surface at an inlet thereof, and limiting surface being configured such that said limiting surface and the moving surface define an accumulator chamber therebetween, said accumulator chamber opening in a direction opposite to a feed direction of the moving surface and gradually decreasing in volume in the feed direction, said accumulator chamber being configured to promote accumulation of the coating medium in a region ahead of said metering slot relative to the feed direction; and a plurality of adjusting mechanisms, said plurality of said adjusting mechanisms distributed along a direction transverse to the feed direction and configured to be independently activated relative to one another, said plurality of adjusting mechanisms positioned adjacent to said coater bed and configured to alter the relative position of said limiting surface with respect to the moving surface and to thereby alter a geometry of said accumulator chamber such that the rate at which the volume decreases in the feed direction is altered.

59. The coating device of claim 58, wherein said plurality of said adjusting mechanisms are configured to be activated at least one of electrically, hydraulically, pneumatically, hydro-pneumatically, and manually.

60. The coating device of claim 58, wherein at least one of said plurality of said adjusting mechanisms comprises a pressure hose.

61. The coating device of claim 58, wherein said plurality of said adjusting mechanisms is comprised of a pressure hose sectioned into a plurality of chambers.

62. A process of applying a liquid or viscous coating medium onto a moving surface, the moving surface being an outer surface of one of a fiber material web and a transfer element for transferring the coating medium to a fiber material web, said process comprising:

providing a coating device including a coater having a coater bed and a coater rod rotatably mounted to said coater bed, said coater rod and the moving surface together defining a metering slot therebetween; said coater bed having a limiting surface at an inlet thereof; said limiting surface and the moving surface defining an accumulator chamber therebetween; and an adjusting mechanism positioned adjacent to said coater bed and configured to adjust at least one position of said limiting surface relative to the moving surface and thereby change the geometry of said accumulator chamber such that the rate at which said accumulator chamber decreases in volume in the direction of the moving surface is altered;

adjusting a coating weight of the coating medium by adjusting said accumulator chamber geometry; and applying the coating medium to the moving surface through said metering slot.

63. The process of claim 62, wherein said at least one position of said limiting surface further comprises a plurality of positions of said limiting surface at locations along said limiting surface in a direction transverse to a coating medium feed direction and wherein the process further comprises a step of selectively adjusting a relative position of said limiting surface at each of said plurality of positions to thereby adjust a transverse profile of the coating medium applied to the moving surface.

* * * * *

UNITED STATES PATENT AND TRADEMARK OFFICE

CERTIFICATE OF CORRECTION

PATENT NO. : 6,589,340 B1
DATED : July 8, 2003
INVENTOR(S) : Bernert et al.

It is certified that error appears in the above-identified patent and that said Letters Patent is hereby corrected as shown below:

Column 5,
Line 63, delete “is”.

Column 12,
Line 54, delete “b”.

Column 18,
Line 18, delete “ina”, and substitute therefore -- in a --.

Signed and Sealed this

Twenty-seventh Day of July, 2004

JON W. DUDAS
*Acting Director of the United States Patent and Trademark Office*